US005327982A

United States Patent [19]

Trahan et al.

[11] Patent Number: 5,327,982

[45] Date of Patent: Jul. 12, 1994

[54] DRILL STRING JAR APPARATUS

[75] Inventors: Wilson J. Trahan; Rayford J. Simon, both of Carencro, La.

[73] Assignee: Raytec, Inc., Scott, La.

[21] Appl. No.: 959,561

[22] Filed: Oct. 13, 1992

Related U.S. Application Data

[63] Continuation-in-part of Ser. No. 622,924, Dec. 6, 1990, abandoned.

[51] Int. Cl.[5] ..... E21B 31/107

[52] U.S. Cl. ..... 175/304; 175/321; 166/178; 166/237

[58] Field of Search ..... 166/178, 301, 382, 386; 175/58, 299, 300, 304

[56] References Cited

U.S. PATENT DOCUMENTS

| | | | |
|---|---|---|---|
| 1,885,043 | 10/1932 | Beck | 175/304 |
| 1,978,847 | 10/1934 | Spang | 175/304 |
| 2,008,743 | 7/1935 | Black | 175/304 |
| 2,051,911 | 8/1936 | Siracusa | 255/27 |
| 2,059,540 | 11/1936 | Stephan | 175/304 |
| 2,591,130 | 4/1952 | Brown et al. | 255/27 |
| 2,962,098 | 11/1960 | Conrad | 175/304 |
| 2,978,048 | 4/1961 | Walker | 175/299 |
| 3,406,770 | 10/1968 | Arterbury et al. | 175/299 |
| 3,853,187 | 12/1974 | Sutliff et al. | 175/297 |
| 4,376,468 | 3/1983 | Clark | 166/178 |
| 4,688,649 | 8/1987 | Buck | 175/299 |
| 4,694,917 | 9/1987 | Heidemann et al. | 175/299 |
| 4,889,198 | 12/1989 | Buck | 175/304 |

*Primary Examiner*—Thuy M. Bui
*Assistant Examiner*—Frank S. Tsay
*Attorney, Agent, or Firm*—Pravel, Hewitt, Kimball & Krieger

[57] ABSTRACT

In a drill string jar apparatus having an elongated tool body positionable within a drill string, which would also include a latch mandrel movable within a bore of the tool body between a first neutral position and fired up or fired down positions; a substantially continuous channel formed in the interior wall of the tool body, a shoulder portion on the exterior wall of the latch mandrel body for latching into the channel of the tool body when the mandrel is in the neutral position and slots in the wall of the latch mandrel for allowing the mandrel body to flex inwardly sufficiently to disengage the shoulder portion from the channel in the tool body and allow the latch mandrel to move upward or downward within the bore of the tool body depending upon the direction of the force imparted on the mandrel and make contact with the upper or lower end of the tool in order to dislodge a tool below the jar apparatus.

14 Claims, 5 Drawing Sheets

DRILL STRING JAR APPARATUS

This is a continuation-in-part of co-pending U.S. patent application Ser. No. 07/622,924, filed Dec. 6, 1990, now abandoned and hereby incorporated by reference.

BACKGROUND OF THE INVENTION

1. Field of the Invention

The present invention relates to oil well drilling. More particularly the present invention relates to an apparatus utilized on a drill string so that when sufficient force is exerted on the apparatus the apparatus shifts and jars loose a tool that may be stuck at the bottom of the bore hole.

2. General Background

In the process of drilling oil wells, which is usually accomplished with the use of a drill bit at the end of a continuous plurality of sections of drill pipe, called the "drill string" many tools are utilized at the end of the string in order to accomplish various tasks. Often times, during the use of these tools, a tool may become stuck or lodged within the drill bore, and must be retrieved in order to continue the drilling process. This retrieval is accomplished by the use of some type of grabbing apparatus at the end of the drill string in combination with a jarring tool.

As known in the art, a jarring tool is an apparatus which when utilized in conjunction with the drill string has either a mechanical or other type of latch engaged in the tool body, so that when sufficient force is placed on the string, the tool body is jarred loose, and when the string is encountered by the jarring motion of the tool body, oftentimes this will result in a unsticking of the tool, and therefore subsequent retrieval.

Of course, this type of jarring tool must work within the confined space of the drill string, and therefore due to this factor, there is oftentimes a malfunctioning of the mechanical latching mechanism in the present state of the art. In addition, because many state-of-the-art tools have a plurality of latching fingers around the circumferential wall of the tool body, force on the tool body is placed between the fingers and the tool body, and therefore is not evenly distributed around the wall of the tool.

For example, U.S. Pat. No. 4,889,198 issued to Buck entitled "Drilling Jar Latch", discloses a drilling jar latch tool which, as seen in the figures, particularly FIGS. 4, 5, and 6, a plurality of fingers attached to the interior wall of the tool body have tooth projections engaged into a continuous channel within the mandrel of the tool. Because of the flexion of the finger on the wall of the body, this would allow the mandrel to slip to engage and disengage during use of the tool. This particular arrangement requires that six different mechanical fingers operate in unison in order to have the proper operation of the tool. Therefore, this tool is susceptible to failure. Other patents have been granted in this field, some of the more relevant being the following:

| U.S. PAT. NO. | TITLE | INVENTOR |
|---|---|---|
| 3,853,187 | Duplex Hydraulic-Mechanical Jar Tool | Sutlif et al. |
| 4,688,649 | Mechanical Drill String Jar | Buck |
| 4,889,198 | Drilling Jar Latch | Buck |
| 4,694,917 | Mechanical Jarring Devices For Use in Drilling | Heidemann et al. |
| 2,059,540 | Oil Well Jar | Stephan |

-continued

| U.S. PAT. NO. | TITLE | INVENTOR |
|---|---|---|
| 2,591,130 | Jar | Brown et al. |
| 2,008,743 | Jar | Black |
| 2,978,048 | Bumper Safety Joint | Walker |
| 2,051,911 | Rotary Jar | Siracusa |
| 1,978,847 | Rotary Jar | Spang |
| 1,885,043 | Rotary Jar | Beck. |

In each case of the patents listed above in addition to the '198 patent to Buck, each of these require the external finger mechanisms operating in conjunction with the movable mandrel and are all susceptible to the problems encountered in the Buck patent.

One of the most important needs in workover well work is the ability to achieve and maintain circulation in hole. Adequate circulation is important for the following reasons:

1) it is needed to wash sand or any other material that may be causing a bridge down hole;

2) it is needed to keep pressure down hole without being blown out of the hole (mud density is varied to achieve the proper pressure down hole—without adequate circulation, the mud density cannot be changed quickly enough to prevent being blown out of the hole);

3) it is needed to keep materials moving up hole, thus keeping tools from getting stuck going in or coming out of the hole;

4) it is needed to allow the setting of hydraulic tools on the work string; hydraulic releasing tools are sometimes set below jars and accelerators to allow the jars or accelerators to be extracted from the hole if the need should arise by "pumping off" (pumping a steel ball down through the string and tools to activate the releasing tool and allow all tools and the string above the releasing tool to be removed from the hole).

SUMMARY OF THE PRESENT INVENTION

The apparatus of the present invention solves the problems in the art in a simple and straight forward manner. What is provided is a jar tool apparatus having a tool body attached at the end of the drill string. The tool body includes an internal mandrel portion having a latching shoulder around the wall of the mandrel, the mandrel further includes a plurality of slots along its body for allowing the body of the mandrel to flex inwardly and outwardly during use of the apparatus. There is further included a housing around the mandrel of the apparatus, the housing further comprising a latch housing having a continuous channel in the wall thereof. Therefore, when the tool is set, the shoulder portion of the latch mandrel seats in the channel of the latch housing. Upon pulling of the drill string with sufficient force, the tool body will be forced to compress slightly allowing the latching shoulder to slide out of engagement with the channel in the latch housing and to allow the tool to move upward and undertake the jarring force. Likewise, upon downward force of the tool body by the drill string, when the shoulder is seated within the latch housing channel, the tool body again will flex inwardly and will allow the shoulder to disengage the housing channel and jar against the lower portion of the string.

The latch and latch mechanism of the present invention was developed to provide maximum I.D. or flow-through for the greatest volume capacity for circulation downhole of any two-way mechanical jar. This is a critical factor in coil-tubing applications, for the reasons mentioned in the Background of the Invention. The inside diameter of the jar is usually the smallest diameter in the string - thus, the larger the I.D. of the jar, the more fluid flow that can be achieved and the larger releasing balls can be used for hydraulic releasing tools positioned below the jar.

Due to the design of the apparatus of the present invention, the ratio of inside diameter to outside diameter is higher than for other similar tools. This is due to the fact that the channel for the latch mandrel is provided in the interior wall of the tool body, instead of in the latch mandrel itself, and the shoulder is provided in the latch mandrel. Having the channel in the interior wall of the tool body, and the shoulder in the latch mandrel instead of on the interior wall of the tool body, as in Buck '198, allows the interior diameter of the latch mandrel (which is the diameter which determines fluid flow through the tool) to be as large as possible for a given size outside diameter of the tool body. As can be seen by comparing FIG. 2 of the present patent application with FIGS. 1-3 of Buck '198, the I.D. (inside diameter) of the apparatus of the present invention can be larger than that of Buck '198 for a given O.D. (outside diameter) of tool body by an amount equal to the thickness of the wall of the latch mandrel plus the depth of the shoulder of Buck '198. For a 2¼" O.D., the I.D. of the present invention is ⅝" which is 1/16" greater than the I.D. (9/16") of the Buck '198 jar with the same O.D. That may not seem like much to one who is not familiar with the daily operations of the oil field, but the I.D. of the present invention is over 11% greater than that of the Buck jar and the difference in flow area is 23%. This means that, in 2¼" O.D. jars, approximately 5 gallons can be pumped downhole (or up-hole) through the I.D. of the present invention in the time that 4 gallons can be pumped downhole (or up-hole) through the I.D. of Buck. Put another way, a job that might require 5 hours of pumping with a 2¼" O.D. Buck jar in place can be done in 4 hours with a 2¼" O.D. jar of the present invention in place. Some other 2¼" O.D. jars have an I.D. of only ½", so the difference in flow area is even greater (56%).

In smaller tools, the difference in I.D.'s is even more pronounced. For example, in jars having a 1 13/16" O.D., the jar of the present invention has an I.D. of 9/16" while the Buck jar has an I.D. of 15/32" (3/32" smaller) and the Grifco jar has an I.D. of 5/16". In jars having a 19/16" O.D., the jar of the present invention has a ⅜" I.D. while the Grifco jar has a 3/16" I.D.

The larger I.D. not only allows greater fluid flow, it also allows larger releasing balls to pass through the jar of the present invention. With all other 2¼" mechanical jars that the inventors are aware of, a hydraulic releasing tool cannot be placed below the jar, but must be placed above, because the I.D. of the jars is too small to allow a 9/16" steel ball to pass therethrough. With the jar of the present invention, a hydraulic releasing tool using a 9/16" steel ball can be placed below the jar, thus allowing the jar to be removed along with the rest of the string should it be necessary to use the hydraulic releasing tool (the hydraulic releasing tool is activated by pumping a 9/16" steel ball down hole).

The contact area between the latch mandrel and the interior of the tool body is greater than in other similar jars (due to the larger O.D. of the latch mandrel). For example, in a jar of the present invention having a 2.25 inch O.D., the O.D. of the latch mandrel is 1.67 inches. A Buck jar having a 2.25 inch O.D. has a latch mandrel with a 1 inch O.D. Since the contact area is equal to the circumference times the length, in latch mandrels having the same length, the latch mandrel of the present invention will have a 67% greater area of contact than a similar Buck latch mandrel (the area is equal to the circumference times the length; the circumference is equal to pi times the diameter; when comparing latch mandrels of the same length, the ratio of the contact areas becomes simply the ratio of the circumferences, which is simply the ratio of the outside diameters; the ratio of the O.D. of the latch mandrel of a 2.25 inch jar of the present invention to the O.D. of the latch mandrel of a 2.25 inch Buck jar is 1.67 to 1—the difference is even more pronounced in smaller jars). This increased contact area is advantageous for the following reasons:

1) the increased contact area allows a greater firing range in comparison to other mechanical jars of which the inventors are aware;

2) the increased contact area eliminates the drag on the shaft found on other designs which reduces the impact when the jar is activated; and 3) the greater contact area allows a 50% thinner wall in the latch mandrel to achieve the same release point (firing setting) as the Buck jar; thus, the range of firing for the jar of the present invention is double that of the Buck jar having a latch mandrel with a wall of the same thickness.

The design of the apparatus of the present invention allows the latching (moving the shoulder of the latch mandrel from a position outside of the channel to inside the channel) of a 2¼41 jar with 50 pounds of force and the necessary force to release (fire) the mechanism may be 2,000 pounds or higher. This allows the jar of the present invention to impart a tremendous amount of force either upward or downward.

The higher release point of the jar apparatus of the present invention allows it to be used in accomplishing a wider assortment of applications in the field. These applications include:

(1) removal of plugs and packers which become sanded up—the higher release point helps pull up this equipment; before the present invention, the tubing would have to be pulled out of the well with a workover rig, which is very costly;

(2) activation of release valves on packers—packers have a release valve on their bottoms; this release valve must be activated to equalize hole pressure below and above the packers so that the packer can be extracted from the well; this release valve over a period of time in the down-hole environment becomes very difficult to activate—the greater the jar action, the greater number of successful activations;

(3) removal of broken wirelines—wireline that breaks becomes balled up in the hole; this line becomes very difficult to extract from the well; a gripper with teeth means to bite into the wireline is attached to the jar of the present invention and is lowered into the hole and the teeth means bite into the wireline; the jar of the present invention then jars the gripper upward; the greater the jar action, the more successful removals of wireline will occur.

It is believed that the apparatus of the present invention is the only sealed, 2-way mechanical jar on the market today with internal splines (the tool body of the preferred embodiment of the present invention preferably includes four spline grooves and the shoulder preferably comprises four spline lugs) and an O.D. of less than 3 inches. It is important that the jar be sealed so that it can be used on rotating hydraulic workover rigs; jars that are not sealed and splined cannot be used on rotating hydraulic workover rigs. The design of the apparatus of the present invention allows internal splining without any reduction of the I.D. of the apparatus.

In the jar apparatus of the present invention, after the shoulder of the latch mandrel leaves the neutral position, there is a time period during which there is no frictional contact between the latch mandrel and the interior wall of the tool body. This minimizes drag, thus maximizing jarring (striking) force in the operation of the jarring apparatus. This is unlike the Buck '198 jar, where there is frictional contact between the arbor and the latch during the entire jarring operation, and unlike the Spang jar, where there is frictional contact between the latching mandrel and the interior wall of the tool body during the entire jarring operation.

The Beck and Spang Jars also differ from the present invention because they are only one-way jars. They cannot impart force both upwardly and downwardly, as can the jar of the present invention.

Therefore, it is the principal object of the present invention to provide a drill string jar apparatus having a latch mandrel which flexes between a first seated position and a second unseated position within a latch housing;

It is the further object of the present invention to provide a drilling jar tool apparatus which does not utilize any movable latching fingers on the exterior of the latch mandrel in the tool body;

It is the further object of the present invention to provide a drill jar tool apparatus which provides for the latching mechanism on the exterior of the latch mandrel, for engaging a channel in the wall of the latch housing; and It is the further object of the present invention to provide a drill string jar tool apparatus which is simple in operation, and has no moving parts other than the flexing of the latch mandrel during operation of the apparatus.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
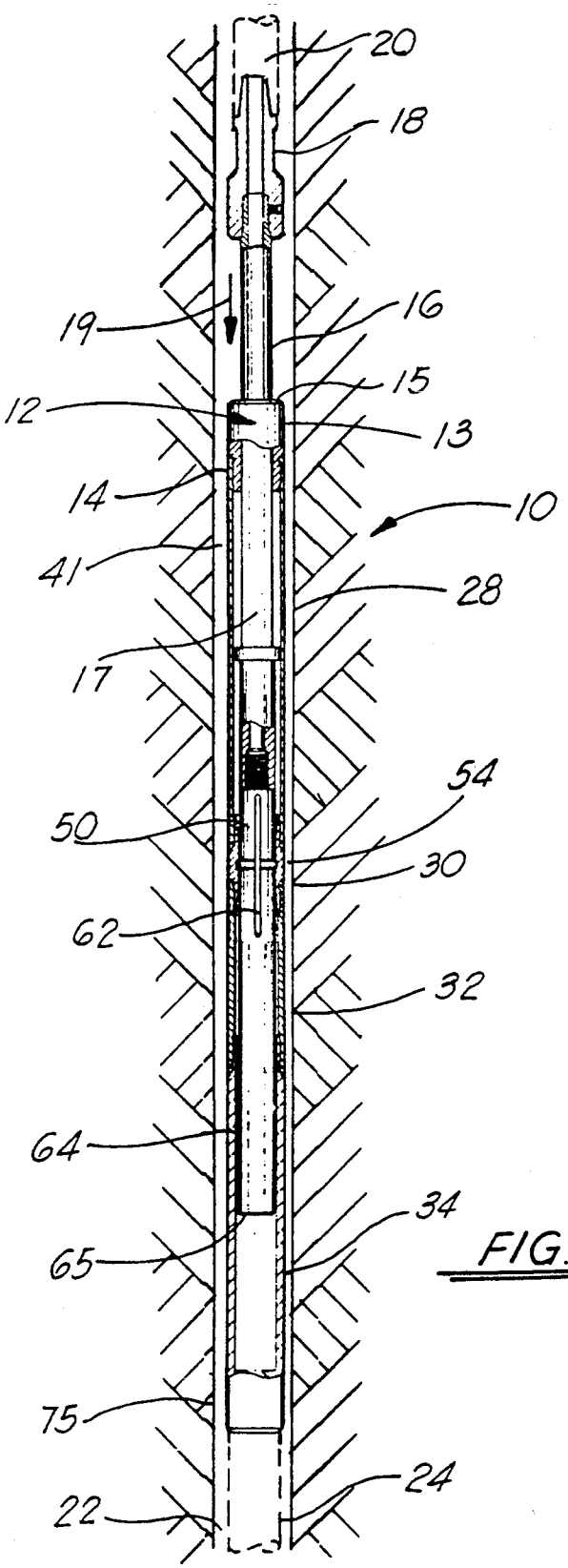
FIG. 1 illustrates an overall cut away view of the preferred embodiment of the apparatus of the present invention down the bore hole.

FIGS. 1-7 illustrate the preferred embodiment of the apparatus of the present invention by the numeral 10. As illustrated in FIG. 1 and in more detail in FIG. 2, apparatus 10 comprises a tool body 12 comprising a housing 14 having a continuous side wall 13, the tool body 12 being of substantially the same diameter as an average drill pipe. As seen in FIG. 1, tool body 12 is extending from a pull shaft 16, which has been connected via a sub 18 to the drill string 20. The apparatus 10 as illustrated would be utilized to retrieve a tool or the like which has been lodged within the bore hole 22 with the use of a grabbing mechanism as illustrated in partial phantom as line 24 in FIG. 1.

Figure 2:
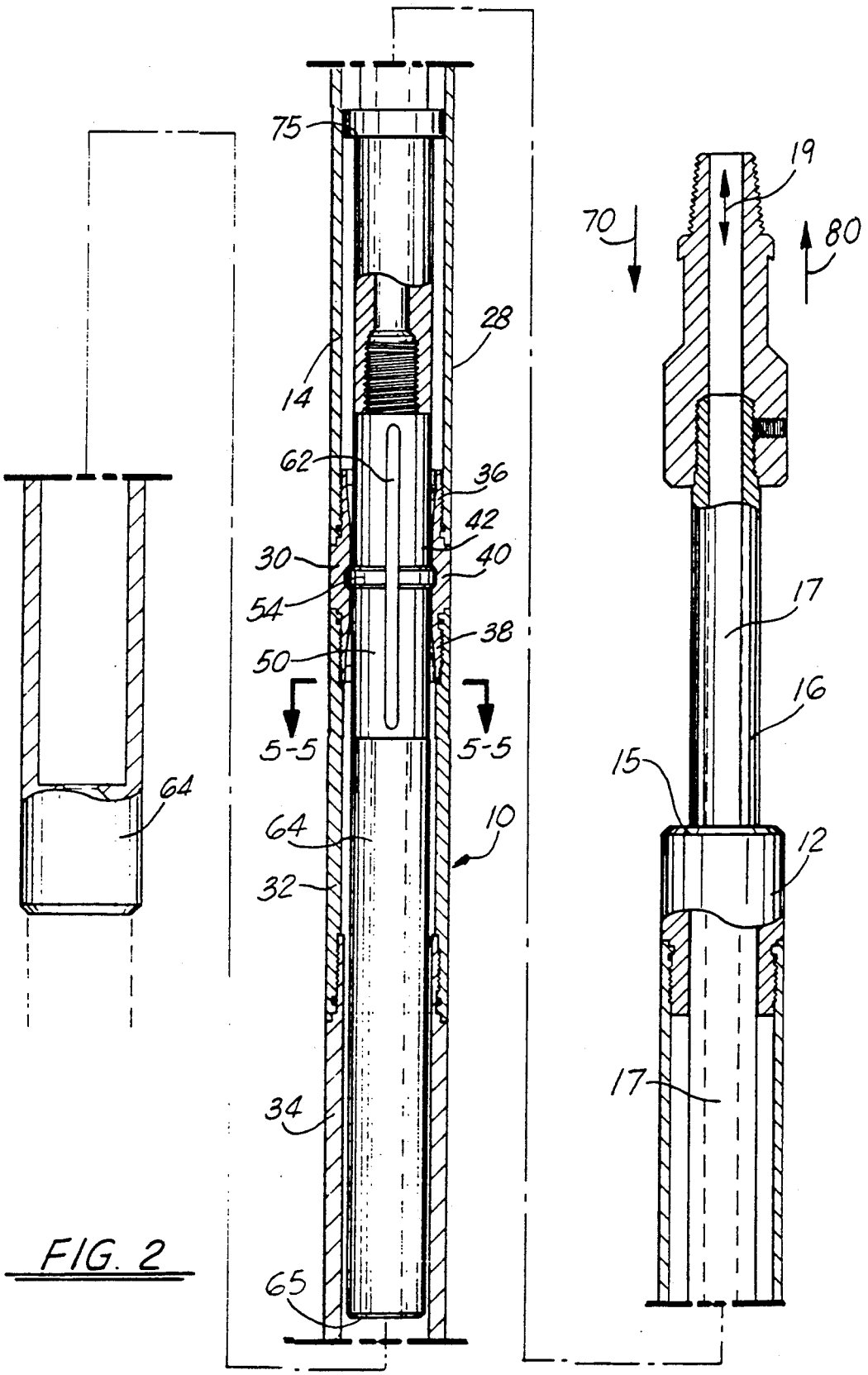
FIG. 2 illustrates a composite blown up view of the preferred embodiment of the apparatus of the present invention.

Furthermore, and as illustrated more clearly in FIG. 2, and as was stated earlier, tool body 12 includes an upper end 15 secured through threading or the like to a pull shaft 16 which includes an internal bore 17 therethrough for allowing fluids or the like to be circulated through the bore 17, for example, in the direction of arrow 19. Likewise, body 12 would continue with bore 17 throughout the length of the apparatus 10, so that the circulation of fluid may continue with the use of the tool while the tool is in position on the string. As illustrated, housing 14 of body 12 comprises an upper housing 28, a central latch housing 30, and an intermediate housing 32, and the lower housing 34 of tool body 12, to form the continuous housing 14.

Turning now to central latch housing 30, which is considered to be a critical part of the entire tool, latch housing 30 includes an upper nipple portion 36 and lower nipple portion 38 to threadably engage the upper portion 28 of housing 14 and the intermediate portion 32 of housing 14 respectively. Latch housing 30 would further include a centrally positioned thickened body area 40, which would form on its interior wall 42 a continuous channel 44 (see FIG. 3), for accommodating the latching mechanism as will be described further.

Figure 3:
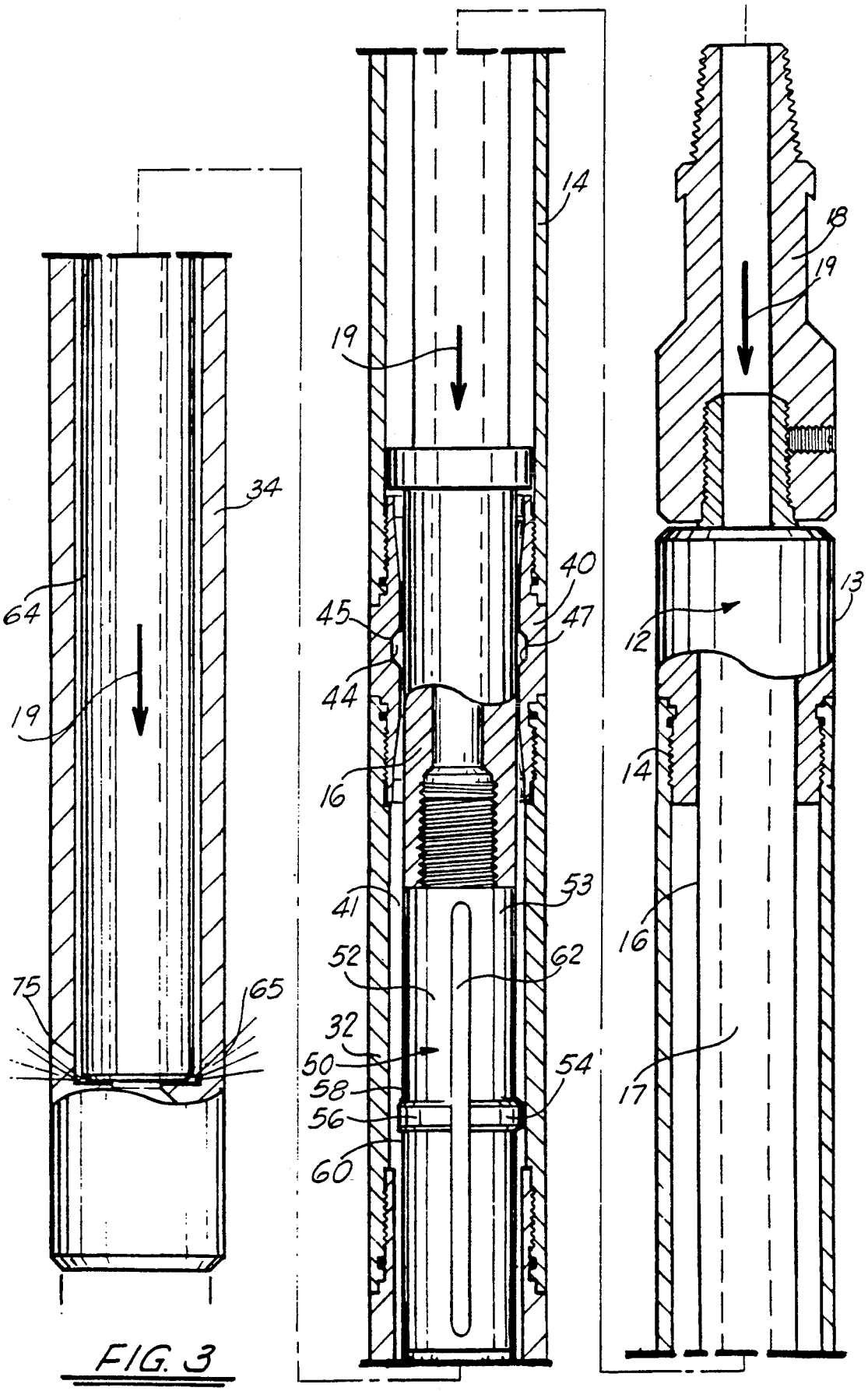
FIG. 3 illustrates the preferred embodiment of the apparatus of the present invention in a fired down latched position.

As further illustrated in FIG. 2, pull shaft 16 extends downwardly through the upper end 15 of housing portion 14. At the lower end of pull shaft 16 there is threadably engaged the latch mandrel 50, which is seen more clearly in FIGS. 2 and 3, includes an annular body portion 52 having a continuous side wall 53 and the diameter of body portion 52 threadably engaged to pull shaft 16, as illustrated in FIG. 3. As further illustrated, latch mandrel 50 includes an latching annular shoulder 54 at substantially midpoint along its length, with shoulder 54 having a central flat annular surface 56, and upper beveled wall 58, and a lower beveled wall 60, the function of which will be described further. Furthermore, along the length of body portion 52 of mandrel 50, there is included a plurality of equally spaced apart slots 62, which serve as a means for allowing the inward and outward flexing of mandrel 50, the function of which shall be described further.

Figure 4:
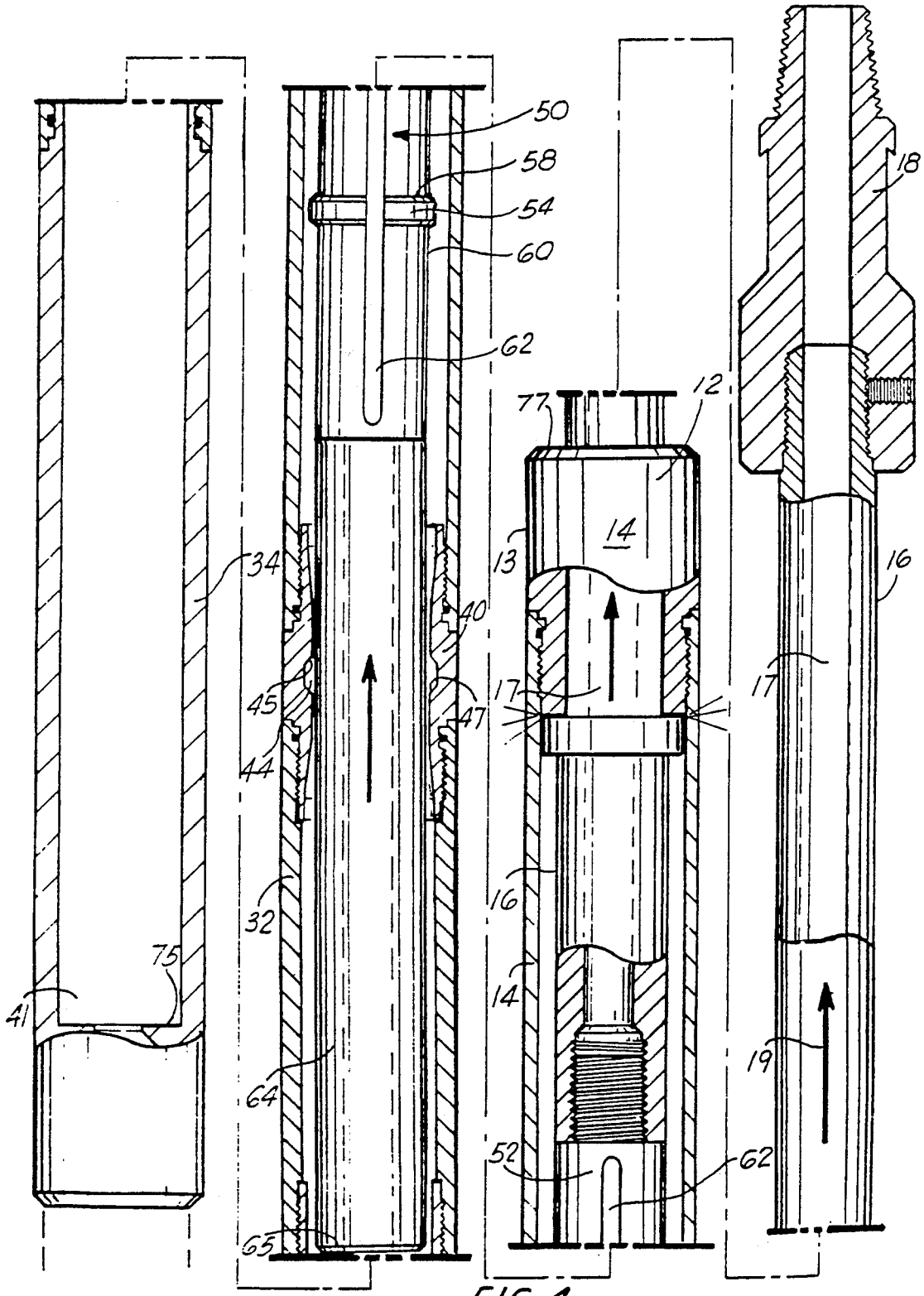
FIG. 4 illustrates the preferred embodiment of the apparatus of the present invention in a fired up latched position.

It should be noted and as further illustrated, particularly in FIG. 2, the lower portion of latch mandrel 50 has threadably engaged thereto a lower down shaft 64, which serves as a means for accomplishing the jarring action of the tool during the operation of the tool. Turning now to the functioning of apparatus 10, as illustrated, reference is made initially to FIG. 2, where as seen in the FIGURE, apparatus 10 is engaged within the bore hole, and will be utilized for retrieving items lodged below it. In the description of the functioning, reference will be made to the three positions of the tool which include the neutral latch position as seen in FIGS. 1 and 2, the fired down position that is illustrated in FIG. 3, and the fired up position that is seen in FIG. 4.

Turning now to the tool in the neutral position, reference is made to FIG. 2. In this FIGURE, latch mandrel 50 is positioned so that the annular latching shoulder 54 is engaged within the continuous annular channel 44 as seen in FIG. 3. As was stated earlier, latching shoulder 54 has upper and lower beveled walls 58, 60, which are beveled at a particular angle, depending on the force one would want to impart either upwardly or downwardly in order for the tool to move from the neutral position as seen in FIG. 2 to the fired positions as seen in FIGS. 3 and 4. For purposes of construction, when the shoulder 54 is in the neutral position as seen in FIG. 3, i.e. positioned within continuous channel 44 of latch housing 30, the angles of the upper angulated wall 45 and lower angulated wall 47 of channel 44 coincide with the respective angles of the upper and lower angulated walls 58, 60 of annular shoulder 54 so that when the mandrel 50 is in the neutral position, shoulder 54 is lodged securely within channel 44 as seen in FIG. 2.

When the entire tool 10 is lowered into position as seen fully in FIG. 1, if one wishes to "fire down" with the tool, when the tool is in the neutral position as seen in FIG. 2, force is imparted downward in the direction of arrow 70, as seen in FIG. 2. Placing downward force on the pull shaft 16 likewise imparts downward force to the latch mandrel 50. When this force is imparted, the shoulder 54 is then forced out of engagement from channel 44, and the tool shifts quickly into the position as seen in FIG. 3, forcing the lower end 65 of down shaft 64 to make jarring contact with the shoulder 75 of lower tool body 34 thus imparting jarring motion to the lodged tool that has been grasped and perhaps dislodging it from its lodged position.

If perhaps one would wish to attempt to dislodge the tool in the fired up position, again reference is made to FIG. 2 where a force is imparted on the pull shaft 16 upwardly in the direction of arrow 80, by pulling on the shaft when latch mandrel 50 is in the neutral position as seen in FIG. 2. Upon imparting sufficient upward force to dislodge the shoulder 54 from the channel 44, again the mandrel body 50 is moved upward, as seen in FIG. 4, and would contact the upper end 77 of upper tool body 14 thus imparting an upward jarring motion which may help to dislodge the stuck tool down hole. In either case, it is clearly seen that the latch mandrel 50, plays a key role in moving from the neutral position as seen in FIG. 2 to the downward or the up position as seen in FIGURES respectively during the operation of the tool.

Figure 5:
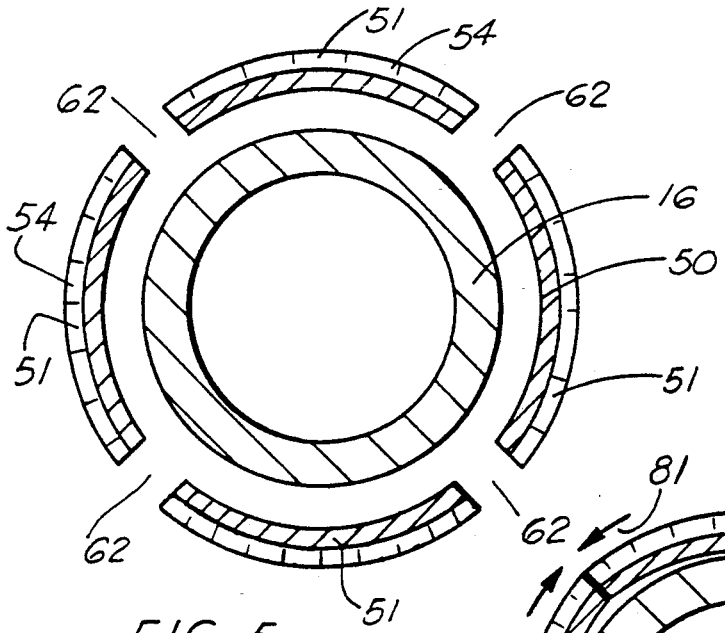
FIG. 5 illustrates a cross section view along lines 5-5 in FIG. 2, illustrating the mandrel in the seated position.
Figure 6:
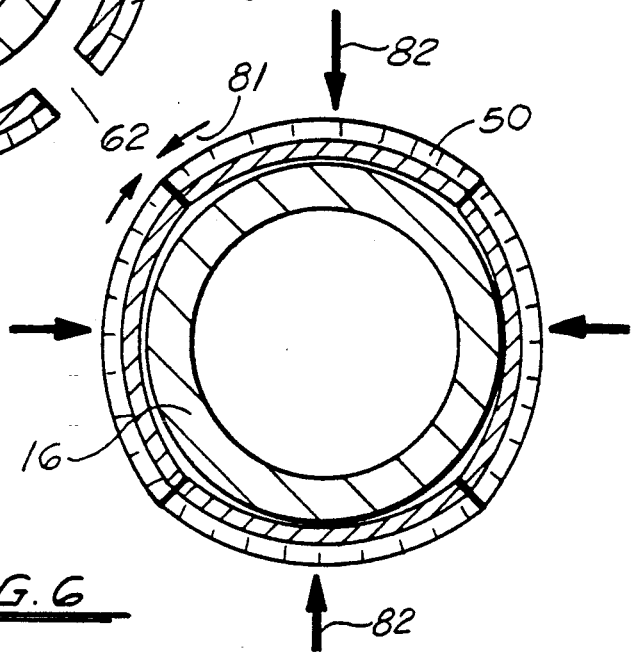
FIG. 6 illustrates a cross section view along lines 6-6 in FIG. 7 with the mandrel in the constricted position during movement to the fired up or fired down position.
Figure 7:
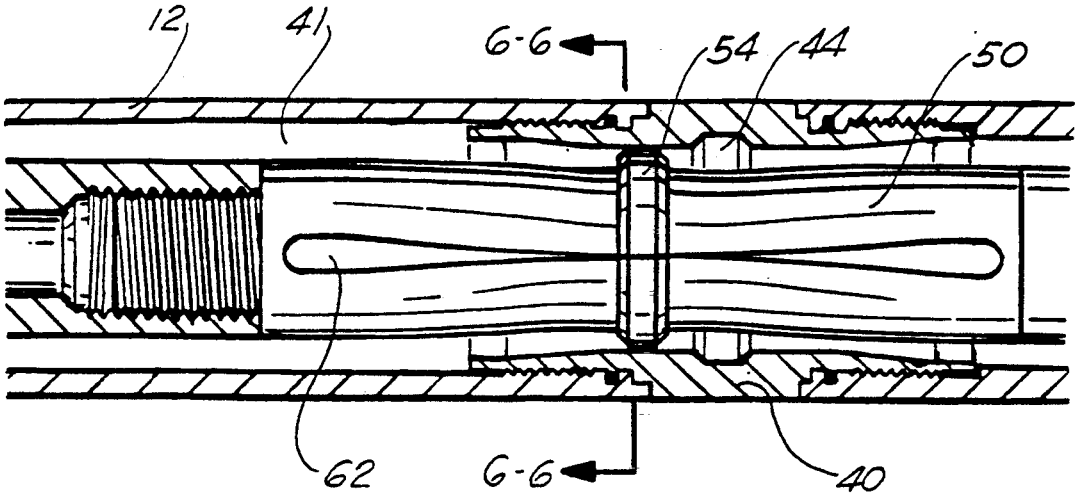
FIG. 7 is a partially cut-away view showing the latch mandrel in a constricted position.

Reference is now made to FIGS. 5 through 7 which illustrate clearly the functioning of mandrel 50 during the operation of the tool. FIG. 5 illustrates in cross section view, along lines 5-5 in FIG. 2, the latch mandrel 50 as it is in position with the pull shaft 16 housed within the mandrel body 50, as the mandrel is in the fully extended or neutral position as seen in FIG. 2. As illustrated in FIG. 5, there is further illustrated slots 62 positioned equidistant apart around the continuous wall of mandrel 50, and when mandrel 50 is in the open position each of the slots 2 is in the complete extended position as illustrated. Further, there is provided a one-quarter body portion 51 between each of the slots 62 of the mandrel 50, which in effect are allowed to flex during the operation of the tool as will be illustrated further. Further, in FIG. 5 there is illustrated the shoulder 54, which when in the neutral position as seen in FIG. 2, is housed within channel 44 of the latch housing 30 as illustrated.

Turning now to FIGS. 6 and 7, reference is made first to FIG. 7. In this particular FIGURE, the mandrel 50 is being moved either to the fired up or fired down positions during operation of the tool. When the mandrel 50 is moved in such a position, in order to move the shoulder portion 54 out of engagement from channel 44, each of the quadrants 51 of tool body 50 must be moved inwardly in order to allow the shoulder portion to disengage from channel 44 as illustrated in FIG. 7. In order to accommodate this, each of the four slots 62 allow the quadrants 51 to move inwardly toward one another, in the direction of arrows 81, and also to move inwardly in the direction of arrows 82 as seen in FIG. 6, and to almost come in contact with the interior pull shaft 16 as illustrated in FIG. 6. Therefore, when sufficient force is placed on the latch mandrel 50 either in the up position or the down position, the mandrel is allowed to constrict in the manner illustrated in FIGS. 6 and 7 in order to allow the shifting of the apparatus. As further illustrated, when the mandrel does shift beyond the confines of the latch housing 30, and into the annular space 41 of the tool body 12, the mandrel will then expand outwardly back into the expanded configuration as seen in FIGS. 3 and 4 when the mandrel is undergoing the jarring motion.

For purposes of use and construction, there is a critical relationship between the shoulder 54 of mandrel 50 and the channel 44 of the latch housing 30. The relationship is critical in that the angle of walls 58, 60 and the angle of the walls 45, 47 of channel 44 determine the amount of force that is necessary to jar mandrel 50 loose from its neutral position as illustrated in FIG. 2, either fired up or fired down in FIGS. 3 and 4. If the angle relative to the longitudinal axis of tool body 12 is relatively large, the force is relative large, and the jarring motion of the tool will be increased and therefore a greater pounding of the tool against the string will be accomplished. Likewise, if the angle of walls 58, 60, 45, and 47 relative to the longitudinal axis of tool body 12 is relatively small, so that the shoulder 54 slides somewhat easily out of the channel 44, then of course less force will be needed to move the tool from its neutral position, and likewise less force will be incurred when the tool does make contact in the jarring motion. Preferably, the angle remains constant and the thickness is varied to control the firing point. The inventors prefer for the angle to be between 20° and 30° relative to the longitudinal axis of tool body 12, and more preferably the angle is 25°. With this angle the firing point is in the preferred range and there is less wear than at other angles. The 2.25 inch O.D. jar of the present invention having a latch mandrel with 3 bars (⅓ body portions instead of ¼ body portions as shown in the drawings) has a firing range of 8,800 pounds. This compares favorably to similar prior art jars whose firing range was half this amount or less.

Therefore, it is foreseen that the tool can be constructed in various angular relationships between the walls of the channel and the wall of the latching shoulder of the mandrel 50, and the tool can be also manufactured of various strengths and weights in order to likewise effect the outcome and the force necessary in order to accomplish the jarring motion with the tool.

The preferred materials for the apparatus of the present invention are alloy no. 6150 from Vincent Metals in Lafayette Parish, La., for the latch mandrel 50, heat treated to 44-46 Rockwell hardness, alloy no. 4140 for upper housing 28, intermediate housing 32, and the lower housing 34 of tool body 12, and alloy no. 8620 for housing 30, heat treated to 54-56 Rockwell hardness.

It is believed that the apparatus of the present invention is the only sealed, 2-way mechanical jar on the market today with internal splines (the upper housing 28 of the preferred embodiment of the present invention preferably includes four spline grooves (not shown) extending in upper housing 28 along the path that upper shoulder 75 travels from the member which shoulder 75 is shown hitting in FIG. 4 to 15 the top of latch housing 30, and the shoulder 75 can comprise four spline lugs (also not shown)) and an O.D. of less than 3 inches. It is important that the jar be sealed and splined so that it can be used on rotating hydraulic workover rigs; jars that are not sealed and splined cannot be used on rotating hydraulic workover rigs. The design of the apparatus of the present invention allows internal splining without any reduction of the I.D. of the apparatus. The splines allow the entire apparatus to be rotated when pull shaft 16 is rotated, thus allowing the use of the tool on rotating hydraulic workover rigs.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A drill string jar apparatus comprising:

a) an elongated tool body positionable within a drill string and having an upper end, a lower end, an interior wall, an exterior wall, a bore, and a longitudinal axis;

b) a latch mandrel moveable within the bore of the tool body, between a first neutral position, and a fired-up position or a fired-down position, the latch mandrel having a body having an exterior wall;

c) a substantially continuous channel having angulated walls and formed in the interior wall of the tool body, the angulated walls being angulated with respect to the longitudinal axis of the tool body;

d) latching means on the exterior wall of the latch mandrel body for latching into the channel of the tool body when the latch mandrel is in the neutral position, the latching means comprising a substantially continuous raised shoulder portion on the exterior wall of the latch mandrel body for engaging the channel when the latch mandrel is in the neutral position;

e) constriction means on the latch mandrel for allowing the latch mandrel body to move inwardly sufficiently to disengage the latching means from the channel in the tool body and thus allow the latch mandrel to move upward or downward from the channel within the bore of the tool body depending on the direction of the force imparted on the mandrel;

f) an upper pull shaft attached to the upper end of the latch mandrel for pulling the latch mandrel out of the neutral position into the fired-up position when force is imparted in an upward direction; and g) a down shaft below the latch mandrel for making contact with the lower end of the tool body when force is applied in a downward direction to unlatch the mandrel from the tool in the neutral position, wherein the force necessary to move the latch mandrel from the neutral position is a factor of the angulation of the walls of the channel when the shoulder portion is engaged with the channel while the tool is in the neutral position.

2. The apparatus of claim 1, further comprising a latch housing within the tool body for forming the continuous channel in the wall of the tool body.

3. The apparatus of claim 1, wherein the constriction means comprises a plurality of slots formed in the exterior wall of the latch mandrel body for allowing movement of the exterior wall inwardly upon the application of force.

4. The apparatus of claim 1, wherein:

the channel has an upper angulated wall and a lower angulated wall; and the shoulder portion has an upper beveled wall and a lower beveled wall, the upper beveled wall of the shoulder portion registering with, and having an angle coinciding with the angle of, the upper angulated wall of the channel when the mandrel is in the neutral position, and the lower beveled wall of the shoulder portion registering with, and having an angle coinciding with the angle of, the lower angulated wall of the channel when the mandrel is in the neutral position.

5. The apparatus of claim 4, wherein:

the continuous channel includes a flat annular portion intermediate the upper angulated wall and the lower angulated wall, and the shoulder portion further comprises a central flat annular surface between the upper beveled wall and the lower beveled wall which corresponds to and registers with the flat annular portion of the channel.

6. The apparatus of claim 1, further comprising:

means for providing that between the time that the latch mandrel is unlatched and the time that latch mandrel reaches the fired-up position or fired-down position, the latch mandrel travels without the shoulder contacting the interior wall of the tool bore.

7. A drill string jar apparatus comprising:

a) an elongated tool body positionable within a drill string having upper and lower ends, a longitudinal axis, an interior wall, and a continuous bore therethrough;

b) a latch mandrel movable within the bore of the tool body, between a neutral position and a first fired position above the neutral position and a second fired position below the neutral position;

c) a substantially continuous channel formed in the interior wall of the tool body, the channel having an upper angulated wall and a lower angulated wall, the upper and lower angulated walls being angulated with respect to the longitudinal axis of the tool body;

d) shoulder means on the exterior wall of the latch mandrel body for latching into the channel of the tool body when the mandrel is in the neutral position, the shoulder means having an upper beveled wall and a lower beveled wall, the upper beveled wall of the shoulder means registering with and having an angle coinciding with the angle of the upper angulated wall of the channel when the mandrel is in the neutral position, and the lower beveled wall of the shoulder means registering with, and having an angle coinciding with the angle of, the lower angulated wall of the channel when the mandrel is in the neutral position; and e) means on the latch mandrel for allowing the mandrel body to flex inwardly sufficiently to disengage the shoulder means from the channel in the tool body and allow the latch mandrel to move into one of the fired positions as a result of force imparted on the latch mandrel.

8. The apparatus of claim 7, wherein:

the continuous channel includes a flat annular portion intermediate the upper angulated wall and the lower angulated wall, and the shoulder means further comprises a central flat annular surface between the upper beveled wall and the lower beveled wall which corresponds to and registers with the flat annular portion of the channel.

9. The apparatus of claim 7, further comprising an upper pull shaft attached to the upper end of the latch mandrel for pulling the latch mandrel out of the neutral position into an up position when force is imparted in an upward direction; and a down shaft below the latch mandrel for making contact with the lower end of the tool body when force is applied in a downward direction to unlatch the mandrel from the tool in the neutral position, wherein the force necessary to move the latch mandrel from the neutral position is a factor of the angulation of the walls of the channel when the shoulder means is engaged with the channel while the tool is in the neutral position.

10. The apparatus of claim 7, further comprising:

means for providing that between the time that the latch mandrel is unlatched and the time that latch mandrel receives the fired-up position or fired-down position, the latch mandrel travels without the shoulder contacting the interior wall of the tool bore.

11. A drill string jar apparatus, comprising:

a) an elongated tool body positionable within a drill string, including an upper end and a lower end, and having a continuous bore therethrough, a longitudinal axis, and an interior wall;

b) a latch mandrel positionable within the bore of the tool body, between a neutral position and a first fixed position above the neutral position and a second fired position below the neutral position, the latch mandrel having a body having an exterior wall;

c) a channel formed in the interior wall of the tool body for securing the mandrel in the neutral position, the channel having an upper angulated wall and a lower angulated wall, the upper and lower angulated walls being angulated with respect to the longitudinal axis of the tool body;

d) a raised shoulder means on the exterior wall of the latch mandrel body for cooperating with the channel in the interior wall of the tool body to maintain the mandrel in the neutral position until force exceeding a predetermined amount is placed thereupon, the shoulder means having an upper beveled wall and a lower beveled wall, the upper beveled wall of the shoulder means registering with, and having an angle coinciding with the angle of, the upper angulated wall of the channel when the mandrel is in the neutral position, and the lower beveled wall of the shoulder means registering with, and having an angle coinciding with the angle of, the lower angulated wall of the channel when the mandrel is in the neutral position; and e) slot means in the latch mandrel body for allowing the mandrel body to flex inwardly sufficiently to dislodge the latch mandrel from the tool body and allow the latch mandrel to move from the neutral to one of the fired positions, depending on the direction and the amount of the force imparted on the mandrel.

12. The apparatus of claim 11, wherein:

the channel includes a flat annular portion intermediate the upper angulated wall and the lower angulated wall, and the raised shoulder means further comprises a central flat annular surface between the upper beveled wall and the lower beveled wall which corresponds to and registers with the flat annular portion of the channel.

13. The apparatus of claim 11, further comprising an upper pull shaft attached to the upper end of the latch mandrel for pulling the latch mandrel out of the neutral position into the first fired position when force is imparted in an upward direction; and a down shaft below the latch mandrel for making contact with the lower end of the tool body when force is applied in a downward direction to unlatch the mandrel from the tool in the neutral position, wherein the force necessary to move the latch mandrel from the neutral position is a factor of the angulation of the walls of the channel when the shoulder means is engaged with the channel while the tool is in the neutral position.

14. The apparatus of claim 11, further comprising:

means for providing that between the time that the latch mandrel is unlatched and the time that latch mandrel reaches the fired-up position or fired-down position, the latch mandrel travels without the shoulder contacting the interior wall of the tool bore.

* * * * *